United States Patent [19]

Thornton

[11] 4,062,492

[45] Dec. 13, 1977

[54] LIQUID-APPLICATOR NOZZLES

[75] Inventor: Leonard Thornton, London, England

[73] Assignee: Molins Limited, London, England

[21] Appl. No.: 674,207

[22] Filed: Apr. 6, 1976

[30] Foreign Application Priority Data

Apr. 10, 1975 United Kingdom ..... 14691/75

[51] Int. Cl.[2] ..... B05B 1/14

[52] U.S. Cl. ..... 239/125; 118/411; 239/568

[58] Field of Search ..... 239/119, 125, 552, 568; 118/50, 411, 412; 156/578

[56] References Cited

U.S. PATENT DOCUMENTS

| | | | |
|---|---|---|---|
| 3,413,143 | 11/1968 | Cameron et al. | 118/411 X |
| 3,462,851 | 8/1969 | Urbas et al. | 239/568 X |
| 3,790,087 | 2/1974 | Banyas et al. | 239/568 X |
| 3,815,822 | 6/1974 | Davies et al. | 239/125 |

*Primary Examiner*—John J. Love

*Assistant Examiner*—Michael Mar

*Attorney, Agent, or Firm*—John C. Smith, Jr.

[57] ABSTRACT

A nozzle for applying adhesive or other liquid to a surface comprises a box-like member with a slot in one of its faces, and an internal partition separating first and second components in the box-like member. One or more projecting portions of one edge of the partition extend into the slot, while other portions of the partition's one edge are recessed to form a weir over which liquid may flow between the components. The slot, through which liquid passes for application to the surface, is thus an interrupted slot, applying a series of short lengths of liquid to the surface, which is of advantage in obtaining a clean separation of the nozzle and the surface after liquid application. The box-like member may be in two parts, one on each face of the partition, and these three members may be bolted together to allow easy replacement of the partition if a change of slot configuration is required.

12 Claims, 3 Drawing Figures

LIQUID-APPLICATOR NOZZLES

This invention relates to nozzles for use in apparatus for applying liquids (e.g. flowable adhesive) to a surface such as a carton blank, or a web of paper.

A nozzle embodying the present invention may with advantage be used in apparatus of the type disclosed and claimed in U.S. Pat. No. 3,815,822 issued June 11, 1974, wherein provision is made for liquid such as flowable adhesive to be circulated continuously from a container via a feed conduit to an applicator nozzle and thence via a return conduit back to the container. The nozzle has a discharge orifice which is in communication with said conduits and is permanently open. It is preferably arranged so that the pressure of liquid at said nozzle (at an inner end of said orifice) can be varied between substantially ambient pressure and a higher pressure as this is convenient for controlling application of liquid to any surface placed adjacent said nozzle.

A preferred form of nozzle as disclosed in said U.S. Pat. No. 3,815,822, comprises a box-like member having an orifice in the form of a straight slot formed in one face thereof and a partition inside said member to form first and second compartments therein connected respectively to the feed and return conduits. One edge of the partition is directly opposite the orifice and spaced from the inner surface of said one face of the box-like member, said edge forming a weir over which liquid flows from said first to said second compartment.

Such a nozzle may be moved towards a surface of a carton blank or other article to which adhesive or other liquid is to be applied, a sufficient application of liquid being made by raising the liquid pressure within the nozzle for a selected time, allowing the liquid pressure to fall to substantially ambient pressure and moving the nozzle away from the surface. An area of the surface of configuration similar to that of the orifice is thus coated with the liquid.

However, as the nozzle moves away from the surface, a "link" of liquid remains between the nozzle and the applied liquid on the surface until a critical separation is achieved, the critical separation being related to the physical characteristics (e.g. viscosity, surface tension) of the liquid and the length of the slot. If the critical separation is substantial then, on breaking of the link of liquid, part of the liquid which formed the link may not return to the nozzle or subside into the liquid coating the surface but may separate entirely especially if, as the nozzle moves away, the carton blank or other article is also moved. The separated liquid then falls (subject to any other local forces produced for example by air currents) as one or more droplets which ultimately impinge upon adjacent objects e.g. on some part of the carton blank or other article, or of the machine of which the nozzle is a part, to create undesired contamination thereof; such an effect is especially objectionable if the liquid is an adhesive.

It is an object of the invention to provide an improved form of nozzle of the general form defined above, but with which the critical separation, and hence the above-explained contamination of adjacent objects, is minimised.

According to the invention therefore we provide a nozzle for use in applying adhesive or other liquid to a surface, comprising a box-like member having an orifice in the form of a straight slot formed in one face thereof and a partition inside said member to form first and second compartments therein, one edge of said partition being directly opposite said orifice, in which said one edge has at least one projecting portion extending into and closing a corresponding portion of said slot, and at least two other portions each spaced from the inner surface of said one face of said member so as to form a weir over which liquid may flow from said first to said second compartment.

Such a nozzle therefore has an interrupted slot and in use applies a series of short lengths of liquid to a surface. The or each projecting portion of the one edge of the partition may be narrower than the other portions thereof, so that the corresponding spacing between each length of applied liquid and the next is shorter than each of those lengths, hence for most purposes (e.g. in the application of adhesive to a carton blank to enable folded portions of such blank to be secured together to form a container) the result is as effective as if a continuous line of liquid, equal in length to the slot, were applied. However, the fact that the width of any one link of liquid, as the nozzle moves away from the surface, is only a fraction of the length of the slot makes much smaller the critical separation between the nozzle and the surface at which the link breaks, and thus in most instances enables the separation of droplets and resultant contamination explained above to be eliminated.

It is to be understood that the number of projecting portions (and hence of intervening other portions) required in said one edge of the partition is to be determined in any particular case in relation to the characteristics of the adhesive or other liquid to be applied and related parameters such as expected working temperature. It may in many cases be most expeditious to determine the optimum number of projecting portions by experiment, and the structure of a nozzle embodying the invention may readily be made such that the partition is quite easily removable so that it may be replaced by another partition with a different number of projecting portions.

In order that the invention may be well understood a preferred embodiment thereof will now be descirbed, with reference to the accompanying drawings in which.

Figure 2:
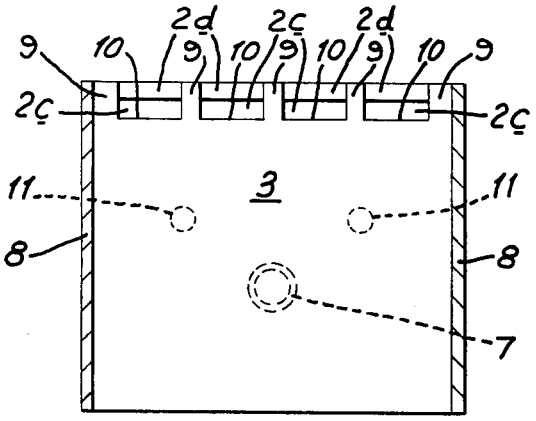
FIG. 2 is a view on the line II—II of FIG. 1.
Figure 3:
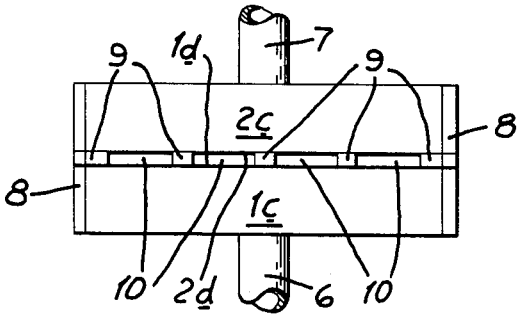
FIG. 3 is a plan view of the nozzle of FIGS. 1 and 2.

The nozzle shown in the drawings comprises two body members 1, 2 and partition 3. The members 1, 2 have solid base portions 1*a*, 2*a* which, in assembled condition as shown, engage opposite faces of the lower part of the partition 3. Intermediate parts of the body members 1, 2 comprise vertical walls 1*b*, 2*b* which are integral with the base portions 1*a*, 2*a* and with upper portions 1*c*, 2*c* which are integral extensions of walls 1*b*, 2*b* but are inclined inwardly towards the partition 3. Recesses in the intermediate and upper parts of the body members 1, 2 are both closed by the partition 3 to provide two compartments 4, 5 within the composite body. Pipes 6, 7 are fitted in apertures in the walls 1*b*, 2*b* to provide inlet and outlet connections for adhesive as indicated by arrows I, O. The compartments 4, 5 are closed by end plates 8 (FIGS. 2 and 3).

The partition 3 is substantially a rectangular plate but its upper edge is of castellated form, having five projecting fingers 9 which are engaged between bevelled end faces 1*b*, 2*d* of the upper inclined wall portions of members 1, 2. Between each adjacent pair of fingers 9 the partition 3 has a recessed portion 10 in its upper edge;

the four portions 10 are in alignment with one another and are below the lower edges of the end faces 1*d*, 2*d* so as to allow adhesive to pass between the two compartments 4, 5. Above each recessed portion 10 of the partition 3, between the end faces 1*d*, 2*d* of the body members 1, 2 is an orifice equal in width to the thickness of the partition and these orifices form nozzle portions through which adhesive may be discharged when desired (as disclosed in said U.S. Pat. No. 3,815,822) by increasing the pressure of the adhesive at the inner end of each orifice i.e. in the compartments 4, 5.

Figure 1:
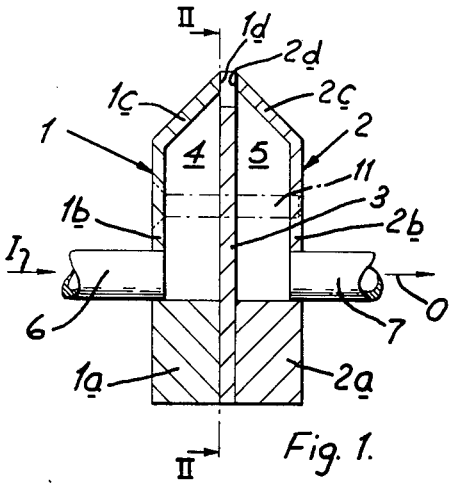
FIG. 1 is a sectional view of an adhesive-applicator nozzle embodying the invention.

The various parts of the nozzle described above may be secured to one another in any convenient manner, for example, by welding. If however it is desired to be able to adjust such a nozzle to allow for changes in conditions of use e.g. different adhesives, then it is more convenient to use a mode of assembly which permits the partition 3 to be changed for one of different dimensions as the number and depth of the recessed portions 10 (and hence of fingers 9) and the width of the orifices are the parameters likely to need alteration—the width of the orifices being as above noted equal to the thickness of the partition. Thus for example the body members 1, 2 and partition 3 could be held together by bolts passing through all three parts, i.e. extending parallel to the pipes 6, 7 as indicated in dashed lines at 11 (FIGS. 1 and 2); with this form of assembly the end plates 8 may conveniently be replaced by integral internal flanges provided at the ends of the body members 1, 2 so as to engage the partition 3 and the outermost fingers 9 of the partition.

In the above description various parts of the nozzle described have been for example referred to as "upper" parts or as being "below" other parts, but use of such terms is not intended to imply that the nozzle described is necessarily to be used in one particular attitude but is merely for convenience in referring to the accompanying drawings. In fact, a nozzle embodying the present invention may be used in any desired attitude, especially when it is used in apparatus as disclosed and claimed in said U.S. Pat. No. 3,815,822.

Various changes and modifications are possible in the nozzle described above without departing from the scope of the invention. Thus for example the number of fingers and recessed portions in the upper edge of the partition may be varied from that shown as also may be the respective widths of the fingers and of the recessed portions which respectively determine the spacing between adjacent orifices and the major dimensions of the orifices.

I claim:

1. A nozzle for use in applying adhesive or other liquid to a surface, comprising a box-like member having an orifice in the form of a straight slot formed in one face thereof, and a partition fixedly mounted inside said member to form first and second compartments therein, one edge of said partition being directly opposite said orifice, said one edge having at least one projecting portion extending into and closing a corresponding portion of said slot, and at least two other portions each spaced from the inner end of said slot so as to form a weir over which liquid may flow from said first to said second compartment, said projecting portion of said one edge of said partition being narrower than said other portions of said one edge.

2. A nozzle for use in applying adhesive or other liquid to a surface, comprising a box-like member having an elongated opening formed in one face thereof, and a partition fixedly mounted inside said member to form first and second compartments therein, said partition having a castellated edge adjacent said opening comprising at least one projecting portion extending into and closing a corresponding portion of said opening to define an orifice at each side thereof, and at least two recessed portions each spaced from the inner end of said opening, so as to form a weir over which liquid may flow from said first to said second compartment.

3. A nozzle as claimed in claim 2, in which said projecting portion of said castellated edge of the partition is narrower than the recessed portions of said edge.

4. A nozzle as claimed in claim 2, in which said box-like member comprise two body members which engage opposite faces of said partition, each of said body members having a recess facing said partition so that said recess is closed by said partition to constitute one of said compartments.

5. A nozzle as claimed in claim 4 in which each body member has an inclined wall bounding said recess, and in which said partition is substantially a rectangular plate having a plurality of projecting portions constituting fingers integral with said plate and engaged between bevelled end faces of said inclined walls.

6. A nozzle as claimed in claim 2, in which the partition is removable.

7. A nozzle as claimed in claim 6, in which the body members and partitions are held together by screws.

8. An improved nozzle for applying liquid such as adhesive to a surface and adapted to minimize critical separation and consequent contamination of adjacent objects, said nozzle comprising:

a. a housing shaving a discharge opening in one face thereof;

b. a partition inside said housing defining with said housing first and second compartments therein, one edge of said partition being directly opposite said opening;

c. feed conduit means connected to said first compartment for feeding liquid into said first compartment, and return conduit means connected to said second compartment for withdrawing liquid from said second compartment;

d. said one edge of said partition comprising at least one projecting portion extending into and closing a corresponding portion of said opening to define an orifice at each side thereof and at least two recessed portions each spaced from the inner ends of said respective orifices so as to form a weir between said first and second compartments;

e. whereby liquid may be continuously circulated from said feed conduit means, through said first compartment, over said weir from said first compartment to said second compartment and from said second compartment through said return conduit, and the application of liquid passing through said orifices onto a surface adjacent said orifices may be controlled by regulating the pressure of said liquid at said orifices.

9. A nozzle as claimed in claim 8 further comprising reservoir means connected to said feed and return conduit means and means for recirculating said liquid and for regulating the pressure of said liquid at said orifices to control passage of liquid through said orifices.

10. A nozzle as claimed in claim 8 in which said housing comprises two body members engaging opposite faces of said partition, each of said body members having a recess facing said partition whereby said recess is closed by said partition to constitute one of said compartments.

11. A nozzle as claimed in claim 10 in which each body member has an inclined wall and a bevelled end face, the bevelled end faces of the two inclined walls defining said opening, and in which said one edge of said partition is of castellated form, the projecting portions being engaged between said bevelled end faces of said inclined walls.

12. A nozzle as claimed in claim 8 wherein said projecting portion of said one edge of said partition is narrower than said recessed portions of said one edge.

* * * * *